US005797381A

United States Patent [19]

Yoshioka et al.

[11] Patent Number: 5,797,381

[45] Date of Patent: Aug. 25, 1998

[54] AIR ASSIST DEVICE OF AN ENGINE

[75] Inventors: Mamoru Yoshioka; Yasuhiro Ooi, both of Susono, Japan

[73] Assignee: Toyota Jidosha Kabushiki Kaisha, Aichi, Japan

[21] Appl. No.: 902,697

[22] Filed: Jul. 30, 1997

[30] Foreign Application Priority Data

Aug. 1, 1996 [JP] Japan ..... 8-203770

[51] Int. Cl.[6] ..... F02M 23/12

[52] U.S. Cl. ..... 123/585

[58] Field of Search ..... 123/585, 531

[56] References Cited

U.S. PATENT DOCUMENTS

| | | | |
|---|---|---|---|
| 3,805,755 | 4/1974 | Miles | 123/585 |
| 4,557,234 | 12/1985 | Ito | 123/585 |
| 4,664,089 | 5/1987 | Pommer et al. | 123/585 |
| 5,170,761 | 12/1992 | Kato et al. | 23/585 |
| 5,487,372 | 1/1996 | Iida et al. | 123/585 |

FOREIGN PATENT DOCUMENTS

| | | |
|---|---|---|
| 57119139A | 7/1982 | Japan . |
| 6213107A | 8/1994 | Japan . |

*Primary Examiner*—Erick R. Solis
*Attorney, Agent, or Firm*—Kenyon & Kenyon

[57] ABSTRACT

An air assist device comprising a plurality of air intake ports formed in the inner wall of an intake duct around a throttle valve. An assist air chamber is formed above the air intake ports and an assist air outflow port is formed in the assist air chamber. To allow the liquid substances flowing from the air intake ports to the assist air chamber to flow down to the assist air outflow port by gravity, the bottom wall of the assist air chamber descends toward the assist air outflow port.

20 Claims, 11 Drawing Sheets

AIR ASSIST DEVICE OF AN ENGINE

BACKGROUND OF THE INVENTION

1. Field of the Invention

The present invention relates to an air assist device of an engine.

2. Description of the Related Art

To atomize the fuel injected from a fuel injector, use has conventionally been made of an air assist device which arranges the fuel injector in the intake passage downstream of the throttle valve, branches off an assist air passage from the intake passage upstream of the throttle valve, and blows the assist air ejected from an assist air ejection port of the assist air passage against the fuel injected from the fuel injector. When atomizing fuel using assist air in this way, however, it is necessary to control the amount of assist air to the optimal amount of assist air for the engine operating state. Therefore, a flow control valve is usually provided in the assist air passage. If such a flow control valve is provided, however, the manufacturing cost rises. Therefore, known in the art is an air assist device which does not provide a flow control valve in the assist air passage, but forms an air intake port of the assist air passage in the inside wall of the intake passage and controls the area of opening of the air intake port by the outer peripheral end face of a throttle valve (see Japanese Unexamined Patent Publication (Kokai) No. 57-119139).

In this air assist device, however, the assist air passage extends upward from the air intake port. If the assist air passage extends upward from the air intake port in this way, the moisture contained in the intake air flowing from the air intake port into the assist air passage will stick to and deposit in the air intake port. If moisture sticks to and deposits in the air intake port, the dust contained in the intake air flowing into the air intake port will gradually deposit in the air intake port and the problem will arise of the air intake port becoming clogged as a result.

Further, if moisture sticks to and deposits in the air intake port, in cold regions, there is also the problem that the deposited moisture would freeze up the throttle valve when the engine is stopped.

In particular, in an internal combustion engine where blowby gas is fed into the intake passage upstream of the throttle valve, the moisture, oil, and other liquid matter contained in the blowby gas can make the air intake port much easier to clog and further make the throttle valve much easier to freeze up.

SUMMARY OF THE INVENTION

An object of the present invention is to provide an air assist device capable of preventing the air intake port from clogging.

According to the present invention, there is provided an air assist device of an engine having an intake passage and a fuel injector arranged in the intake passage, the device comprising an assist air passage for feeding assist air to fuel injected from the fuel injector; a throttle valve arranged in the intake passage upstream of the fuel injector; an air intake port formed in an upper inner wall of the intake passage and connected to the assist air passage, an opening area of an opening of the air intake port being controlled by the throttle valve; and liquid substance deposition preventing means for preventing a liquid substance from being deposited in the air intake port.

BRIEF DESCRIPTION OF THE DRAWINGS

These and other objects and features of the present invention will become more apparent from the following description of the preferred embodiments given with reference to the attached drawings, in which.

DESCRIPTION OF THE PREFERRED EMBODIMENTS

Figure 1:
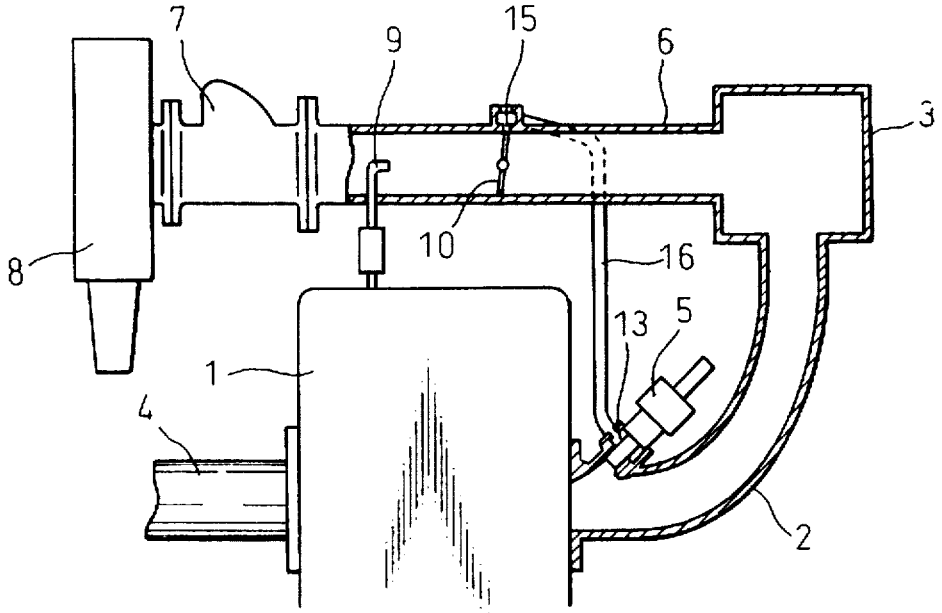
FIG. 1 is an overall view of an internal combustion engine.

Referring to FIG. 1, 1 is an engine body, 2 an intake tube, 3 a surge tank, and 4 an exhaust manifold. A fuel injector 5 is attached at each intake tube 2 to inject fuel into the intake port of the corresponding cylinder. The surge tank 3 is connected through an intake duct 6 and an air flow meter 7 to an air cleaner 8. A blowby gas feed pipe 9 for feeding blowby gas exhausted from the engine body 1 into the intake duct 6 is arranged in the intake duct 6. Further, a throttle valve 10 is arranged inside the intake duct 6 downstream of the blowby gas feed pipe 9.

Figure 2:
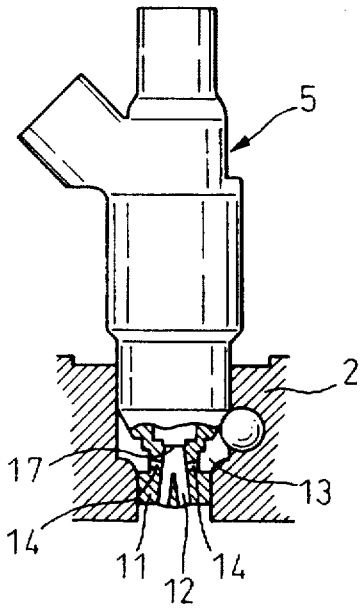
FIG. 2 is a partial sectional side view of an assist air type fuel injector.

As shown in FIG. 2, an assist air adapter 11 is attached to the front end of the fuel injector 5. The adapter 11 is provided with a fuel-air flow through hole 12 branched into two, an assist air chamber 13 formed around the adapter 11, and an assist air ejection port 14 opening inside the fuel-air flow through hole 12. On the other hand, as shown in FIG. 1, an air intake port 15 is formed in the inside wall of the intake duct 6 around the throttle valve 10. This air intake port 15 is connected through an assist air conduit 16 to the assist air chamber 13.

In the embodiment shown in FIG. 1, at least part of the air intake port 15 always opens inside the intake duct 6 upstream of the throttle valve 10. Therefore, the air inside the intake duct 6 upstream of the throttle valve 10 is fed by the difference between the pressure inside the intake duct 6 upstream of the throttle valve 10 and the pressure inside the intake tube 2 from the air intake port 15 through the assist air conduit 16 to the assist air chamber 13. Next, the air, that is, the assist air, is ejected from the assist air ejection port 14 to the inside of the fuel-air flow through hole 12. The fuel is ejected from the nozzle port 17 of the fuel injector 5 to the inside of the fuel-air flow through hole 12. The assist air ejected from the assist air ejection port 14 promotes the atomization of the injected fuel.

Figure 3:
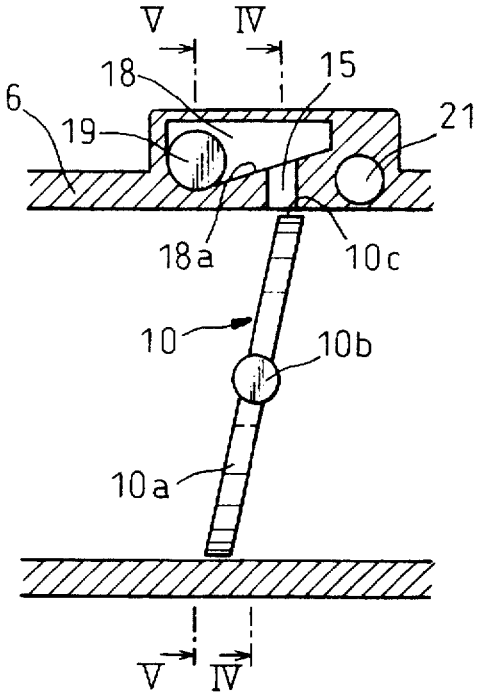
FIG. 3 is a side sectional view of the parts around the throttle valve of FIG. 1.
Figure 4:
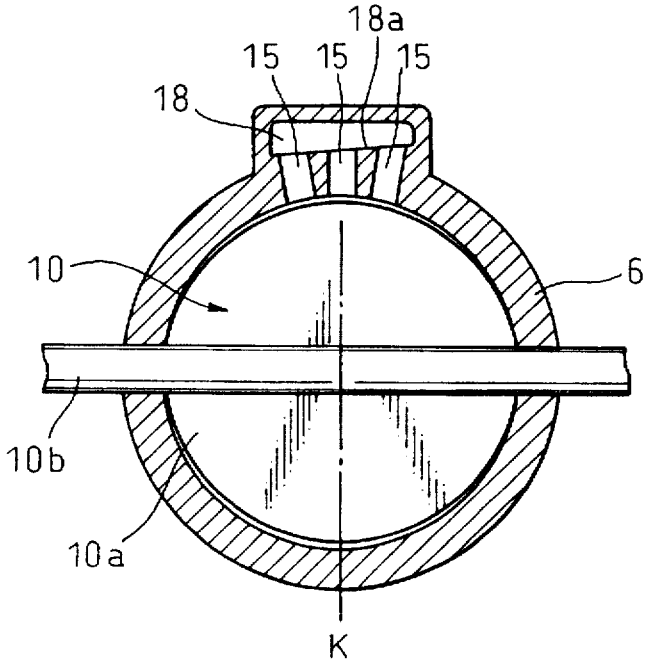
FIG. 4 is a sectional view along line IV—IV of FIG. 3.
Figure 5:
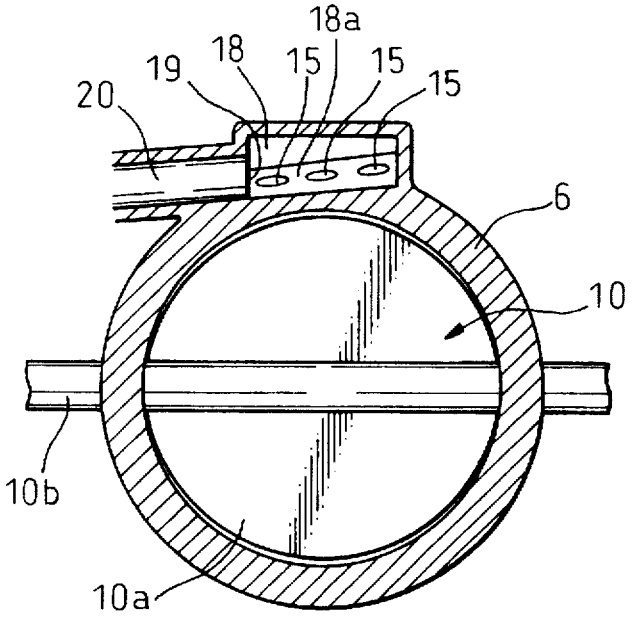
FIG. 5 is a sectional view along line V—V of FIG. 3.

FIG. 3 to FIG. 5 are enlarged views of the parts around the throttle valve 10. As shown in FIG. 3 to FIG. 5, the inside wall of the intake duct 6 has a circular cross-section and the valve body 10*a* of the throttle valve 10 has a circular contour. The valve stem 10*b* of the throttle valve 10 extends substantially in the horizontal direction. A plurality of air intake ports 15 are formed at the top of the inside wall of the intake duct 6 furthest away from the valve stem 10*b*. In the embodiment shown in FIG. 3 to FIG. 5, three air intake ports 15 are arranged symmetrically with respect to the plane of symmetry perpendicular to the valve stem 10*b*, but it is also possible to symmetrically arrange more than four or two air intake ports 15 with respect to the plane of symmetry K.

As shown in FIG. 3 to FIG. 5, an assist air chamber 18 is formed in the wall of the intake duct 6 above the air intake ports 15. All of the air intake ports 15 open inside the assist air chamber 18. On the other hand, an assist air ejection port 19 is formed in the assist air chamber 18. This assist air ejection port 19 is connected through an assist air passage 20 to the assist air conduit 16 (FIG. 1).

In the embodiment shown in FIG. 3 to FIG. 5, the bottom wall 18*a* of the assist air chamber 18 is formed from a flat surface slanting toward the assist air outflow port 19. The air intake ports 15 open into the assist air chamber 18 at the flat bottom wall 18*a*. Therefore, the moisture in the intake air flowing from the air intake ports 15 to the assist air chamber 18 and the moisture and oil in the blowby gas flowing from the air intake ports 15 to the assist air chamber 18 will flow down along the flat bottom wall 18*a* to the assist air outflow port 19 by gravity. Consequently, almost none of the moisture and oil, that is, the liquid substances, will stick and deposit in the air intake ports 15, so almost no dust etc. will deposit in the air intake ports 15 and therefore it becomes possible to prevent the air intake ports 15 from clogging.

In this embodiment, further, the assist air passage extending from the assist air outflow port 19 through the assist air passage 20 and assist air conduit 16 to the assist air chamber 13 around the adapter 11 continues to descend without rising once. Therefore, a liquid substance flowing out from the assist air outflow port 19 will be exhausted through the assist air ejection port 14 into the intake tube 2.

Further, in this embodiment, as shown in FIG. 3, heating means, that is, a passage 21 for the engine coolant or recirculated exhaust gas, is formed next to the air intake port. Therefore, even if a liquid substance sticks inside the air intake port 15, the liquid substance will be heated by the engine coolant or recirculated exhaust gas flowing inside the passage 21, whereby the liquid substance will be vaporized.

In the related art, however, the area of the flow channel of the assist air is increased along with an increase of the amount of intake air when the amount of intake air is small and is held substantially constant when the amount of intake air exceeds a certain value. Therefore, the amount Q of assist air changes about as shown by the solid line in FIG. 18 with respect to the throttle opening degree. That is, at the time of idling operation, there is an optimal amount of assist air with respect to the atomization of the injected fuel. This optimal amount of assist air is shown by $Q_0$ in FIG. 18. On the other hand, the optimal amount of assist air gradually increases from $Q_0$ as the throttle opening degree becomes larger. When the throttle opening degree becomes large to a certain extent, the area of the flow channel of the assist air becomes constant, so the amount of assist air no longer increases. When the throttle opening degree becomes further larger next, the difference in pressure before and after the throttle valve becomes smaller, so the amount of assist air is gradually reduced.

FIG. 19A to FIG. 19E show various examples of the case of control of the area of opening of an air intake port Z of assist air formed in the inside wall of an intake passage X by the throttle valve Y arranged in the intake passage X. Note that in FIG. 19A to FIG. 19E, the throttle valve Y is shown at the idling position and the intake air flows in the intake passage X from the top to the bottom.

Figure 19A:
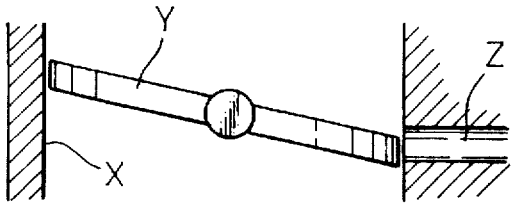
FIGS. 19A to 19E are views for explaining the relationship between the throttle valve and the air intake port.
Figure 19B:
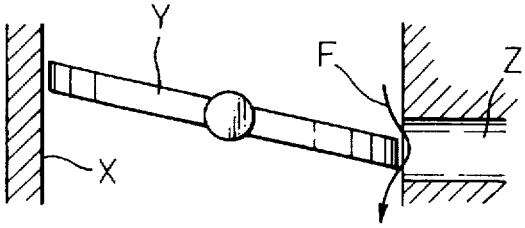
Figure 19C:
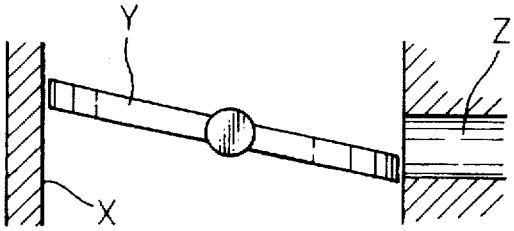
Figure 19D:
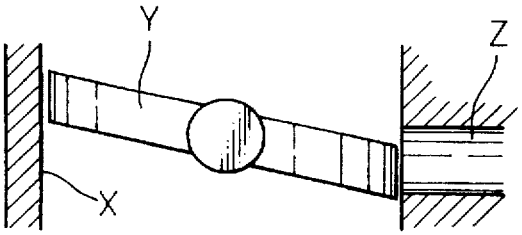

When the air intake port Z is formed in the inner wall of the intake passage X, considering the ease of processing and dimensional accuracy, the air intake port Z is preferably drilled. Therefore, the sectional shape of the air intake port Z is preferably circular. FIG. 19A to FIG. 19D show the case where the sectional shape of the air intake port Z is made circular. Further, FIG. 19A shows the case where the air intake port Z is formed with a relatively small diameter, while FIG. 19B, FIG. 19C, and FIG. 19D show the case where the air intake port 2 is formed with a relatively large diameter.

Figure 18:
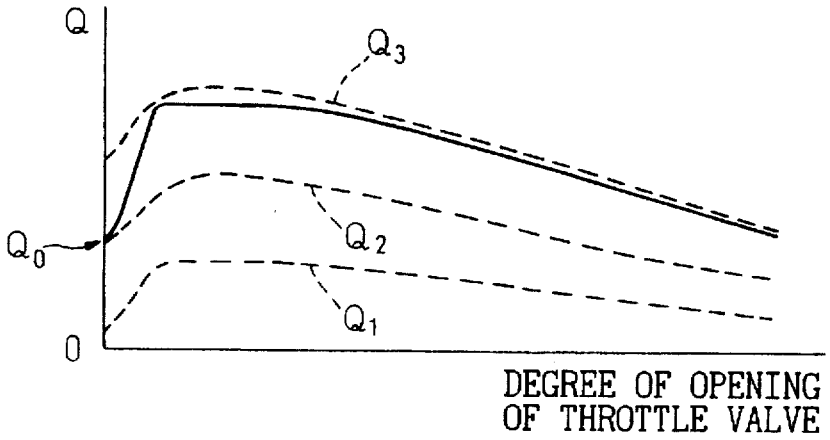
FIG. 18 is a view of the amount Q of assist air.

As shown in FIG. 19A, if the sectional shape of the air intake port Z is formed as a relatively small diameter circular shape, the area of the flow channel of the assist air becomes considerably small and as a result, as shown by the broken line $Q_1$ in FIG. 18, the amount of assist air becomes considerably small overall with respect to the optimal value shown by the solid line. Therefore, in this case, it becomes difficult to promote the atomization of the injected fuel well.

To promote the atomization of the injected fuel, it is necessary to increase the amount of the assist air. Therefore, it is necessary to increase the area of the flow channel of the air intake port Z. FIG. 19B shows the case of forming the sectional shape of the air intake port Z as a relatively large circular sectional shape and thereby increasing the area of the flow channel of the air intake port Z. In this case, however, if the air intake port Z is arranged so as to open at both the upstream side and downstream side of the throttle valve Y as shown in FIG. 19B, the intake air will not flow into the air intake port Z at the time of idling operation but will flow into the intake passage X downstream of the throttle valve Y as shown by the arrow F. Therefore, in this case, even if the area of the flow channel of the air intake port Z is increased, it is not possible to increase the amount of assist air at the time of an idling operation.

On the other hand, FIG. 19C shows the case of arrangement of an air intake port Z having a relatively large diameter circular sectional shape so as to open just at the upstream side of the throttle valve Y. In this case, the intake air flows into the air intake port Z, so the amount of assist air increases overall as shown by the broken line $Q_3$ in FIG. 18. In this case, however, the area of the opening of the air intake port Z in the intake passage X at the time of an idling operation becomes considerably large, so, as will be understood from the broken line $Q_3$ in FIG. 18, the amount of assist air at the time of an idling operation will end up becoming considerably larger than the optimal value $Q_0$.

On the other hand, if the sectional area of the air intake port Z is made smaller so that the amount of assist air at the time of an idling operation becomes the optimal value $Q_0$, as shown by the broken line $Q_2$ of FIG. 18, the amount of assist air at the time when the throttle valve Y opens will end up becoming smaller than the optimal value shown by the solid line. That is, no matter what the sectional area of the air intake port Z is made and no matter what the positional relationship between the air intake port Z and the throttle valve Y is made, it is not possible to obtain the optimal amount of assist air shown by the solid line in FIG. 18.

As opposed to this, as shown by FIG. 19D, if the thickness of the valve body of the throttle valve Y is made greater, the amount of assist air can be made the optimal value as shown by the solid line in FIG. 18. If the thickness of the valve body of the throttle valve Y is made greater in this way, however, the resistance of the flow channel of the intake passage X at the time of an engine high load operation will become greater and therefore it will not be possible to obtain a high engine output. Therefore, it is not possible to make the thickness of the valve body of the throttle valve Y greater as shown by FIG. 19D.

Figure 19E:
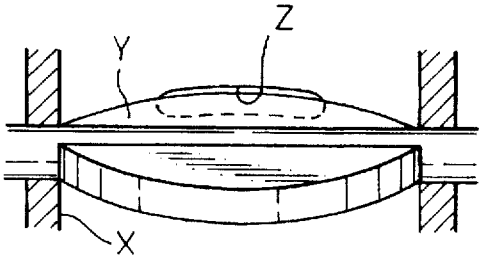

Further, if the sectional shape of the air intake port Z is made a narrow elongated hole as shown in FIG. 19E, it is possible to make the amount of assist air the optimal value $Q_0$ shown in FIG. 18 at the time of idling operation and further it is possible to secure the optimal amount of assist air as shown by the solid line in FIG. 18 when the throttle opening degree becomes large. To make the sectional shape of the air intake port Z a narrow elongated hole shape, however, machining by a milling machine or electrodeposition or other complicated and lengthy processing becomes necessary, therefore there is the problem that a large increase in costs is incurred. Further, if punching using a press is adopted, it is possible to form the narrow elongated hole in a short time, but press working causes stress in the intake duct and results in the problem that the amount of intake air and the amount of assist air at the time of idling operation will end up varying for each intake duct.

As clear from the above explanation, when controlling the amount of assist air by the throttle valve Y, it can be said to be preferable to make the sectional shape of the air intake port Z circular in consideration of the ease of processing and the precision of processing. So long as just a single air intake port Z is provided and the amount of assist air flowing from the air intake port Z is controlled by a throttle valve Y as in the related art, however, it is not possible to secure the optimal amount of assist air. To secure the optimal amount of assist air, it is necessary to provide a plurality of air intake ports Z. Therefore, in the embodiment shown in FIG. 3 to FIG. 5, a plurality of air intake ports 15 are provided.

Referring to FIG. 3 to FIG. 5, in this embodiment, the air intake ports 15 have circular sectional shapes of the same diameter. These air intake ports 15 are drilled from the outside wall of the intake duct 6, therefore the air intake ports 15 extend in the radial direction of the intake duct 6.

Figure 6:
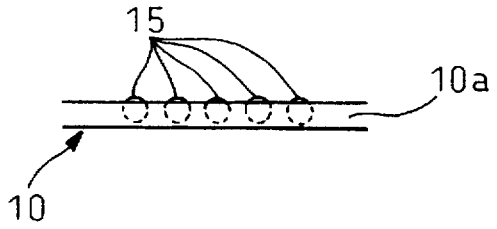
FIG. 6 is a view of the positional relationship between the valve body of the throttle valve and the air intake port.

FIG. 3 to FIG. 5 show when the throttle valve 10 is in the idling position. FIG. 6 shows the positional relationship between the valve body 10*a* and the air intake ports 15 at the time when the throttle valve 10 is in the idling position when seen along the valve body 10*a* of the throttle valve 10. As shown in FIG. 3 and FIG. 6, the air intake ports 15 are arranged so that large parts of the opening portions of the air intake ports 15 are covered by the outer peripheral end face 10*c* of the throttle valve 10 and just the upstream side end regions of the opening portions of the air intake ports open to the inside of the intake duct upstream of the throttle valve 10 when the throttle valve 10 is in the idling position. Note that in the embodiment shown in FIG. 3 to FIG. 6, the areas of the upstream side end regions of the opening portions of the air intake ports at this time all become equal.

Note that the throttle valve 10 is slanted with respect to the lateral cross-section of the intake duct 6 as shown in FIG. 3 when at the idling position. The air intake ports 15 are formed to be aligned along the peripheral edge of the valve body 10*a* as shown in FIG. 6 at this time. That is, the further an air intake port 15 is from the plane K of symmetry of FIG. 4, the more to the upstream side it is positioned. Therefore, the air intake ports 15 are aligned at the same lateral cross-section of the intake duct 6.

Figure 7:
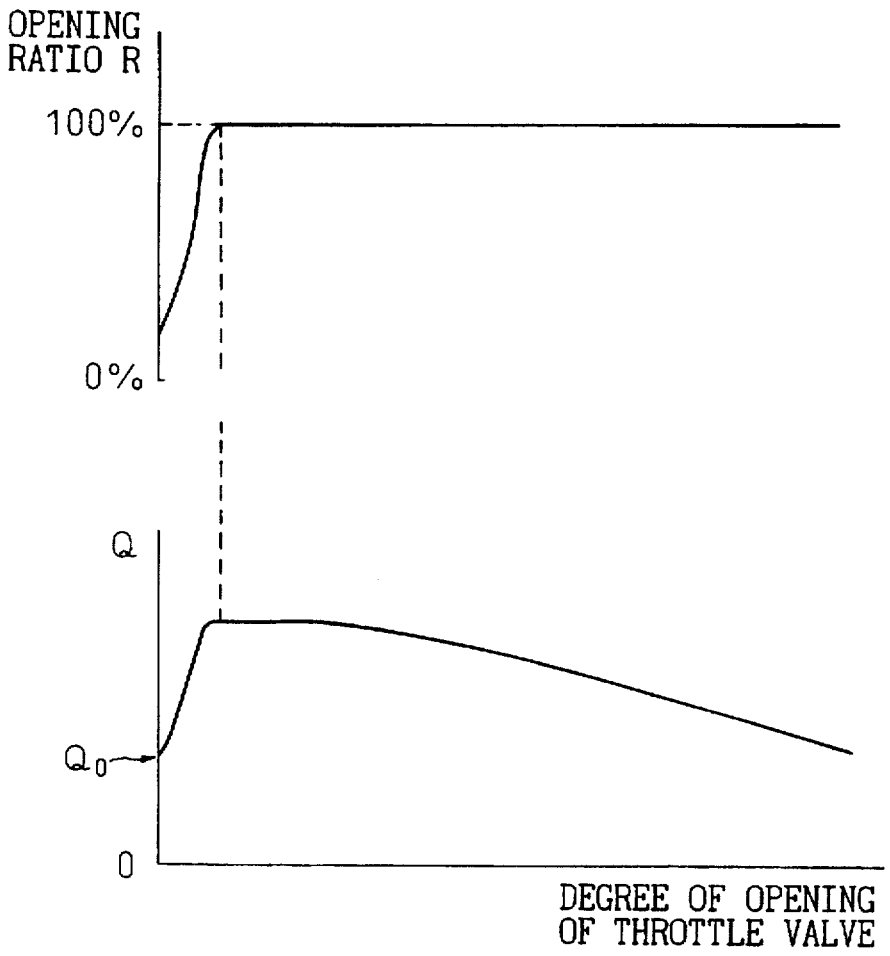
FIG. 7 is a view of the opening ratio R of the air intake port and the amount Q of assist air.

FIG. 7 shows the relationship between the opening ratio R of the opening portion of the air intake port 15 into the intake duct 6 upstream of the throttle valve 10 and the throttle opening degree in the embodiment shown in FIG. 3 to FIG. 6 and the relationship of the amount Q of assist air and the throttle opening degree. As shown from FIG. 3 to FIG. 6, if a plurality of air intake ports 15 are provided, the total flow area of the air intake ports 15, that is, the area of the flow channel of the assist air, can be made considerably large, while the opening ratio R at the time of idling operation can be made considerably small. As a result, it is possible to make the amount Q of assist air match the optimal value shown by the solid line in FIG. 18. Note that $Q_0$ in FIG. 7 shows the optimal amount of assist air at the time of an idling operation in the same way as $Q_0$ shown in FIG. 18.

Figure 8:
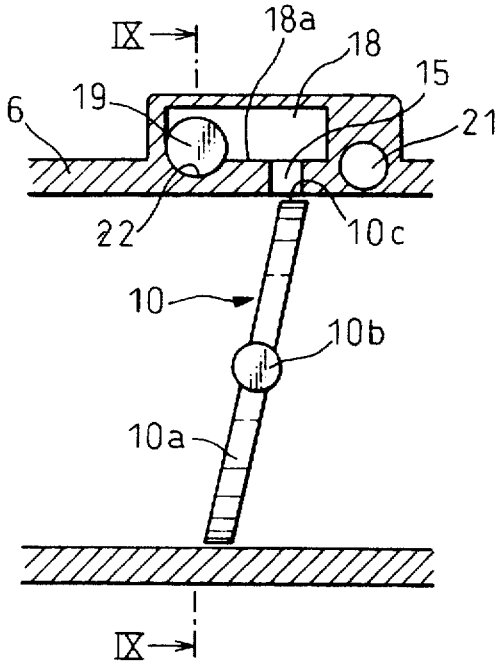
FIG. 8 is a side sectional view of the parts around the throttle valve showing another embodiment.
Figure 9:
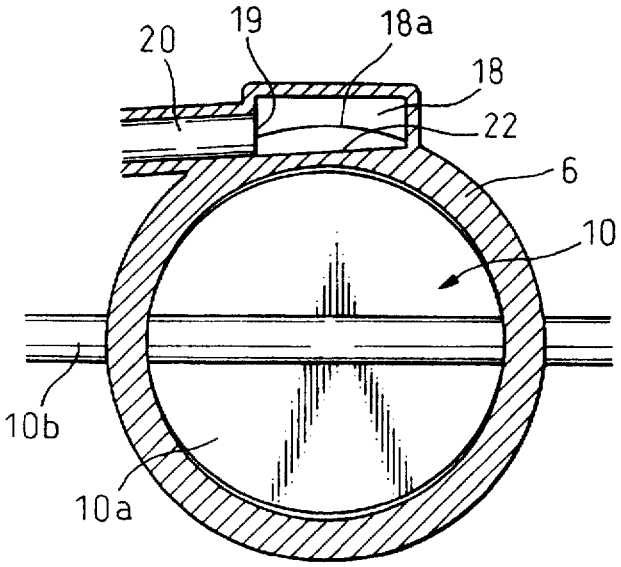
FIG. 9 is a sectional view along line IX—IX of FIG. 8.

FIG. 8 and FIG. 9 show another embodiment. In this embodiment, the bottom wall 18*a* of the assist air chamber 18 is cylindrical. The air intake ports 15 open inside the assist air chamber 18 at this cylindrical bottom wall 18*a*. At one side of the assist air chamber 18 is formed a slanted groove 22 which descends toward the assist air outflow port 19. The liquid substances flowing into the assist air chamber 18 flow down along the cylindrical bottom wall 18*a*, then flow along the slanted groove 22 to flow down to the assist air outflow port 19.

Figure 10:
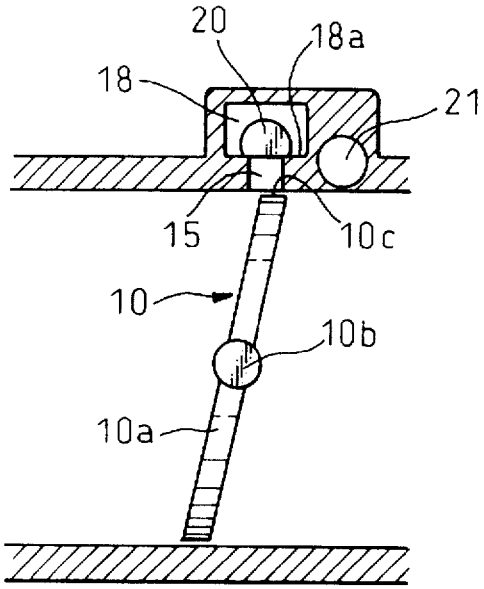
FIG. 10 is a side sectional view of the parts around the throttle valve showing still another embodiment.
Figure 11:
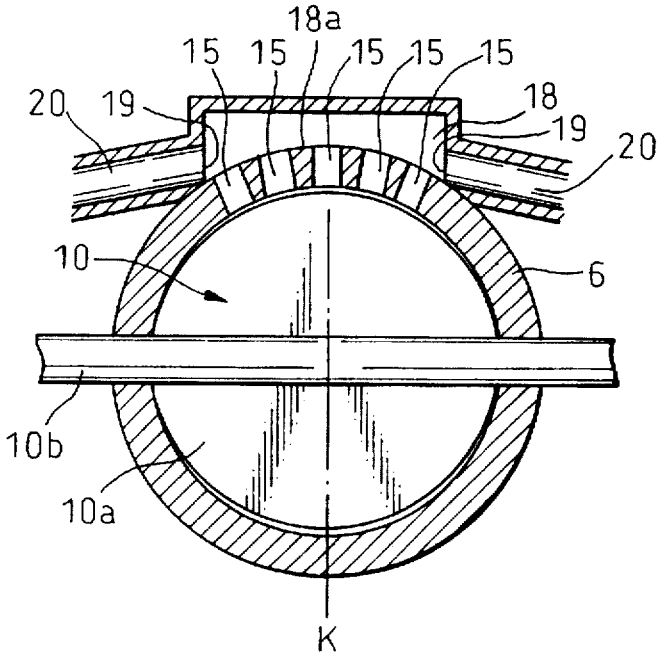
FIG. 11 is a sectional view of FIG. 10.
Figure 12:
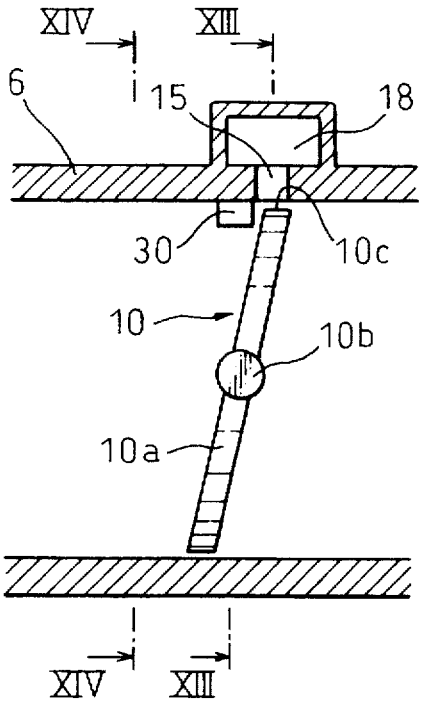
FIG. 12 is a side sectional view of the parts around the throttle valve showing still another embodiment.
Figure 13:
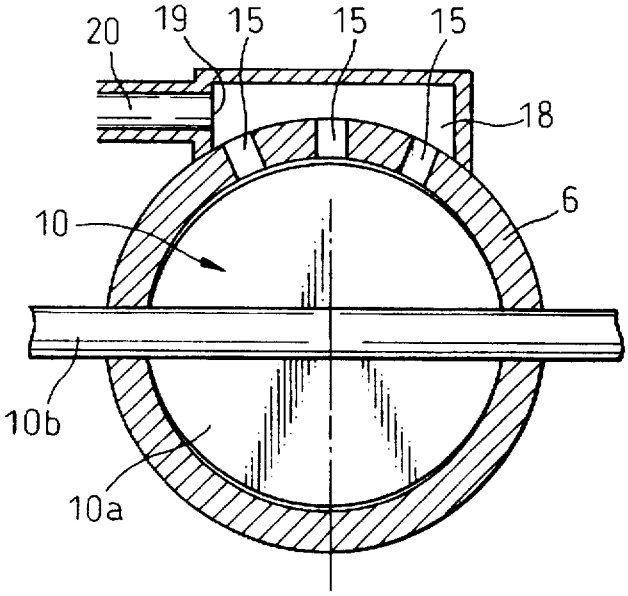
FIG. 13 is a sectional view along line XIII—XIII of FIG. 12.
Figure 14:
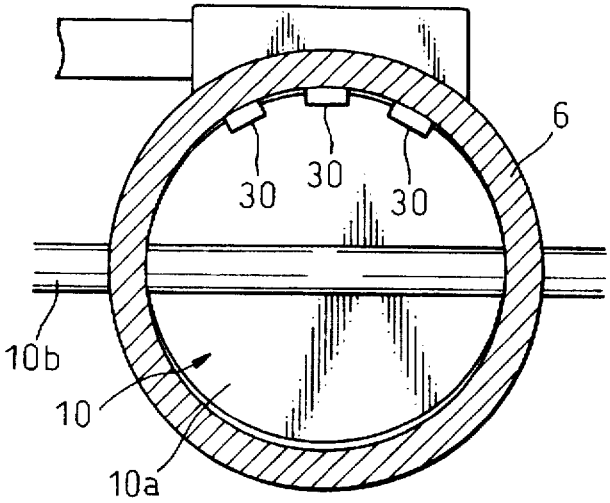
FIG. 14 is a sectional view along line XIV—XIV of FIG. 12.
Figure 15:
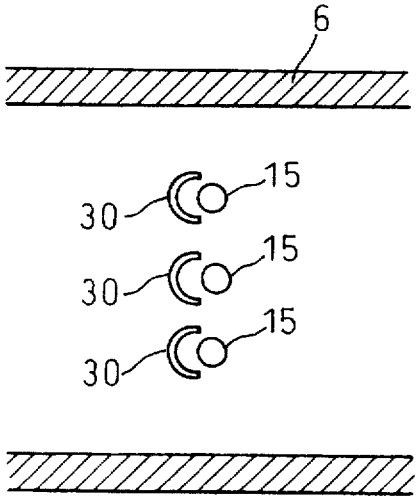
FIG. 15 is a view of the upper inner wall of the intake duct of FIG. 12.

FIG. 10 amd FIG. 11 show still another embodiment. In this embodiment, five air intake ports 15 open in the assist air chamber 18 at the cylindrical bottom wall 18*a* of the assist air chamber 18. Further, in this embodiment, assist air outflow ports 19 are formed at the two ends of the cylindrical bottom wall 18*a*. The assist air outflow ports 19 are connected to corresponding assist air passages 20.

FIG. 12 to FIG. 15 show still another embodiment. In this embodiment, liquid substance blocking projecting walls 30 are respectively formed at the upper inner wall of the intake duct 6 upstream of the air intake ports near the air intake ports 15. In this embodiment, the liquid substance blocking projecting walls 30 are comprised of thin, arc-like projecting walls extending in arcs so as to surround the corresponding air intake ports 15. By provision of such liquid substance blocking projecting walls 30, the liquid substances can pass along the sides of the air intake ports 15 and flow to the downstream sides, so it is possible to prevent liquid substances from flowing into the air intake ports 15.

Figure 16:
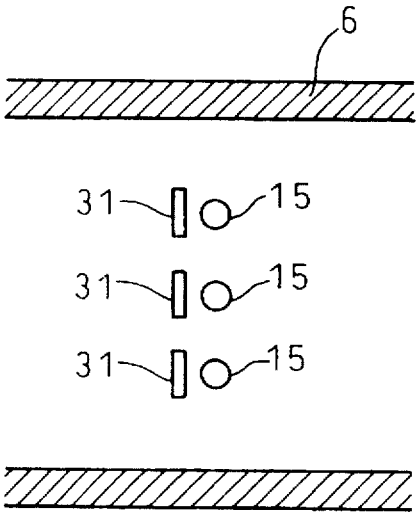
FIG. 16 is a view of the upper inner wall of the intake duct showing still another embodiment.

FIG. 16 shows still another embodiment. In this embodiment, liquid substance blocking projecting walls 31 are respectively formed on the upper inner wall of the intake duct 6 upstream of the air intake ports near the air intake ports 15. In this embodiment, the liquid substance blocking projecting walls 31 are comprised of thin plate-like projecting walls. Even if these liquid substance blocking projecting walls 31 are provided, the liquid substances pass along the sides of the air intake ports 15 and flow to the downstream sides, so it is possible to prevent liquid substances from flowing into the air intake ports 15.

Figure 17:
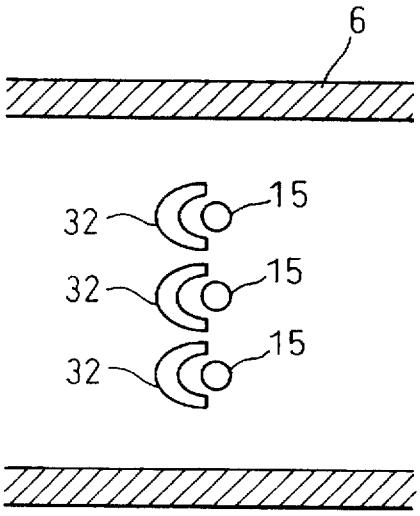
FIG. 17 is a view of the upper inner wall of the intake duct showing still another embodiment.

FIG. 17 shows still another embodiment. In this embodiment, liquid substance escape grooves 32 are respectively formed in the upper inner wall of the intake duct 6 upstream of the air intake ports near the air intake ports 15. In this embodiment, the liquid substance escape grooves 32 are comprised of arc-like escape grooves extending in arcs so as to surround the corresponding air intake ports 15. By provision of such liquid substance escape grooves 32, the liquid substances can flow into the liquid substance escape grooves 32, then pass along the sides of the air intake ports 15, and flow to the downstream sides, so it is possible to prevent liquid substances from flowing into the air intake ports 15.

As explained above, according to the present invention, it is possible to prevent clogging of an air intake port.

While the invention has been described by reference to specific embodiments chosen for purposes of illustration, it should be apparent that numerous modifications could be made thereto by those skilled in the art without departing from the basic concept and scope of the invention.

We claim:

1. An air assist device of an engine having an intake passage and a fuel injector arranged in the intake passage, said device comprising:

an assist air passage for feeding assist air to fuel injected from the fuel injector;

a throttle valve arranged in the intake passage upstream of the fuel injector;

an air intake port formed in an upper inner wall of the intake passage and connected to said assist air passage, an opening area of an opening of said air intake port being controlled by said throttle valve; and liquid substance deposition preventing means for preventing a liquid substance from being deposited in said air intake port.

2. An air assist device as set forth in claim 1, wherein an assist air chamber is formed above said air intake port, said air intake port opens into said assist air chamber, and said liquid substance deposition preventing means is comprised of an assist air outflow port formed in said assist air chamber positioned lower than the opening portion of said air intake port to the assist air chamber and connected to said assist air passage and a bottom wall of the assist air chamber extending from the opening portion of the air intake port to the assist air outflow port so that a liquid substance flowing from the opening portion of the air intake port into the assist air chamber will flow down to said assist air outflow port by gravity.

3. An air assist device as set forth in claim 2, wherein said bottom wall of the assist air chamber is comprised of a slanted surface which slants from the opening portion of said air intake port toward said assist air outflow port.

4. An air assist device as set forth in claim 2, wherein said bottom wall of the assist air chamber is comprised of a cylindrical bottom wall portion extending cylindrically in the circumferential direction of the intake passage and a slanted wall portion formed next to said cylindrical bottom wall portion and descending toward said assist air outflow port and wherein the opening portion of said air intake port is formed at said cylindrical bottom wall portion.

5. An air assist device as set forth in claim 2, wherein said bottom wall of the assist air chamber is comprised of a cylindrical bottom wall extending cylindrically in the circumferential direction of the intake passage, the opening portion of said air intake port is formed at said cylindrical bottom wall, and said assist air outflow ports are formed at the two ends of said cylindrical bottom wall in the circumferential direction.

6. An air assist device as set forth in claim 2, wherein said assist air passage extends downward from the assist air outflow port toward the fuel injector.

7. An air assist device as set forth in claim 1, wherein heating means is provided for heating said air intake port.

8. An air assist device as set forth in claim 7, wherein said heating means is comprised of an engine coolant passage formed at the side of the air intake passage.

9. An air assist device as set forth in claim 7, wherein said heating means is comprised of a recirculated exhaust gas passage formed at the side of the air intake passage.

10. An air assist device as set forth in claim 1, wherein said liquid substance deposition preventing means is comprised of a liquid substance blocking projecting wall formed on the upper inner wall of the intake passage upstream of the air intake port.

11. An air assist device as set forth in claim 10, wherein said liquid substance blocking projecting wall has an arc-like sectional shape extending in an arc so as to surround the opening portion of said air intake port into the intake passage.

12. An air assist device as set forth in claim 10, wherein said liquid substance blocking projecting wall forms a thin, plate in shape.

13. An air assist device as set forth in claim 1, wherein said liquid substance deposition preventing means is comprised of a liquid substance escape groove formed in the upper inner wall of the intake passage upstream of said air intake passage.

14. An air assist device as set forth in claim 13, wherein said liquid substance escape groove extends in an arc so as to surround the opening portion of the air intake port to the intake passage.

15. An air assist device as set forth in claim 1, comprising a plurality of circular cross-section air intake ports formed in an upper inner wall of the intake passage and connected to said assist air passage, said air intake ports being arranged to be aligned along an outer peripheral edge of the throttle valve when the throttle valve is positioned at an idling position, said air intake ports being at least partially covered at the same time by an outer peripheral end face of the throttle valve when the throttle valve is at an idling position, an amount of assist air fed into said assist air passage being controlled by said throttle valve.

16. An air assist device as set forth in claim 15, wherein when the throttle valve is at the idling position, portions of the openings of the air intake ports open in the intake passage upstream of the throttle valve and the remaining portions of the openings of the air intake ports are covered by the outer peripheral end face of the throttle valve and when the throttle valve opens, the entire openings of the air intake ports open in the intake passage upstream of the throttle valve.

17. An air assist device as set forth in claim 15, wherein the air intake ports are arranged to be distributed at the two sides of the plane passing through the center of the throttle valve and perpendicular to the throttle axis.

18. An air assist device as set forth in claim 17, wherein all of the air intake ports have the same diameter.

19. An air assist device as set forth in claim 17, wherein the air intake ports are arranged symmetrically with respect to the plane.

20. An air assist device as set forth in claim 19, wherein one of the air intake ports is arranged on said plane.

* * * * *